US005655935A

United States Patent [19]

Yoshimura

[11] Patent Number: 5,655,935

[45] Date of Patent: Aug. 12, 1997

[54] RECEPTACLE CONTACT USED IN AN ELECTRICAL CONNECTOR

[75] Inventor: Yohji Yoshimura, Yokohama, Japan

[73] Assignee: The Whitaker Corporation, Wilmington, Del.

[21] Appl. No.: 421,575

[22] Filed: Apr. 12, 1995

[30] Foreign Application Priority Data

May 31, 1994 [JP] Japan ..... 6-140992

[51] Int. Cl.[6] ..... H01R 13/428

[52] U.S. Cl. ..... 439/748; 439/857

[58] Field of Search ..... 439/741, 743, 439/744, 745, 746, 748, 849, 885, 857, 249, 251

[56] References Cited

U.S. PATENT DOCUMENTS

| | | | |
|---|---|---|---|
| 3,389,371 | 6/1968 | Maynard | 439/748 X |
| 4,039,241 | 8/1977 | Perry | 439/748 X |
| 4,384,754 | 5/1983 | Douty et al. . | |
| 4,425,018 | 1/1984 | Stenz | 439/717 X |
| 4,589,721 | 5/1986 | Sedig et al. | 439/748 |
| 5,269,699 | 12/1993 | Peloza | 439/849 X |
| 5,489,223 | 2/1996 | Faje et al. | 439/748 |

*Primary Examiner*—Allan N. Shoap
*Assistant Examiner*—Christopher J. McDonald

[57] ABSTRACT

A receptacle contact 100 having a pair of contact arms 112 and lances 114 formed by a U-shaped slot made in the contact arms. At the front ends of the lances 114, latching members 126 are located. At one end of the base plate 113 of the receptacle contact, a conductor-connecting member 104 is provided. When the receptacle contact is placed in the contact cavity 3 of a housing 2 of connector 1, the lances 114 fit into grooves 32, and the latching members 126 engage with a protrusion 42 in the housing 2 thereby latching the contact 100 in the housing 2.

17 Claims, 6 Drawing Sheets

RECEPTACLE CONTACT USED IN AN ELECTRICAL CONNECTOR

FIELD OF THE INVENTION

This invention relates to receptacle contacts and electrical connectors using such contacts intended especially for battery packs.

BACKGROUND OF THE INVENTION

In recent years, the trend in personal computers, especially the notebook-type, is to reduce their size. This was accompanied by a strong demand for the reduction in size of their components including electrical connectors. Receptacle contacts used in electrical connectors are usually of the type described in Japanese Patent Publication No. 87-27513. Such a receptacle contact comprises a flat main body, arms extending from one edge of the main body and lances for latching in the connector housing. The disadvantage of such receptacle contacts was their large size due to the configuration in which the arms and the lances were arranged sequentially in the longitudinal direction.

Receptacle contacts offered for the purpose of the reduction of lengthwise dimensions are known in the art, such as for example, a receptacle contact described in the Japanese Patent Publication No. 91-45873. This receptacle contact 200 is shown in FIG. 10. It has contacting arms 202 extending in one direction from the sides of a nearly rectangular base plate 201 and conductor-connecting members 204 extending in the opposite direction from the edges of the base plate 201. The contacting arms 202 have lances 206 cut out of them. The free ends 203 of the lances 206 are located on the same side as the fixed ends 205 of the contacting arms 202. The receptacle contacts 200 are inserted in a housing (not shown) with the contacting arms 202 and the lances 206 cutting into the inside walls of the housing, thus providing for the proper positioning and securing of the contacts in the housing. However, in such a design, the contacting arms 202 themselves are fixed to the walls rendering them non-elastic, which does not allow them to be spring-loaded. Another problem is that the insertion of such receptacle contacts requires a considerable force due to the fact that the lances 206 lack springiness.

Considering the foregoing, the purpose of this invention is to offer an electrical connector wherein a small-sized receptacle contact distinguished by its small size, and a low force that is required for the contact to be inserted in a housing with sufficient springiness of the contact arms.

SUMMARY OF THE INVENTION

The receptacle contact according to this invention comprises a nearly rectangular base plate, a pair of contact arms extending from both ends of the base plate in one direction which are intended for forming electrical connection with a mating contact, a conductor-connecting member extending from at least one end of the base plate in a second direction, and cantilevered lances formed by U-shaped slots in central parts of the contact arms. The lances extend from the fixed ends of the contact arms and are spread wider than the contact arms. In the vicinity of the front ends of the lances, latching members are located. The electrical connector according to this invention in which these receptacle contacts are used comprises a housing having a number of nearly rectangular cavities for receiving the receptacle contacts and grooves where the contacts are inserted to accommodate the lances including secondary latching protrusions having latching surfaces which are engaged by the latching members.

BRIEF DESCRIPTION OF THE DRAWINGS

An embodiment of the invention will now be described by way of example with reference to the accompanying drawings in which.

DETAILED DESCRIPTION OF THE INVENTION

The receptacle contact according to this invention comprises a pair of contact arms having U-shaped slots forming lances extending outwardly therefrom. The lances have primary latching members. The electrical connector housing according to this invention has grooves accommodating the lances which are provided in the opposed walls between which the receptacle contacts are inserted. The grooves have secondary latching protrusions which become engaged with the primary latching members of the contacts. Such a structure has the following effect. The contact arms of the receptacle contacts are practically independent from the lances used to secure the contacts in the housing, thus making it possible to retain their springiness. Due to flexibility of the lances, the receptacle contacts can be inserted using a low insertion force. The receptacle contacts are reliably secured in the housing by only a latching device, therefore it is possible to obtain small-sized receptacle contacts requiring low effort for the insertion into the housing and making highly reliable electrical connections. The following description provides more detail information in accordance with the drawings.

Figure 1:
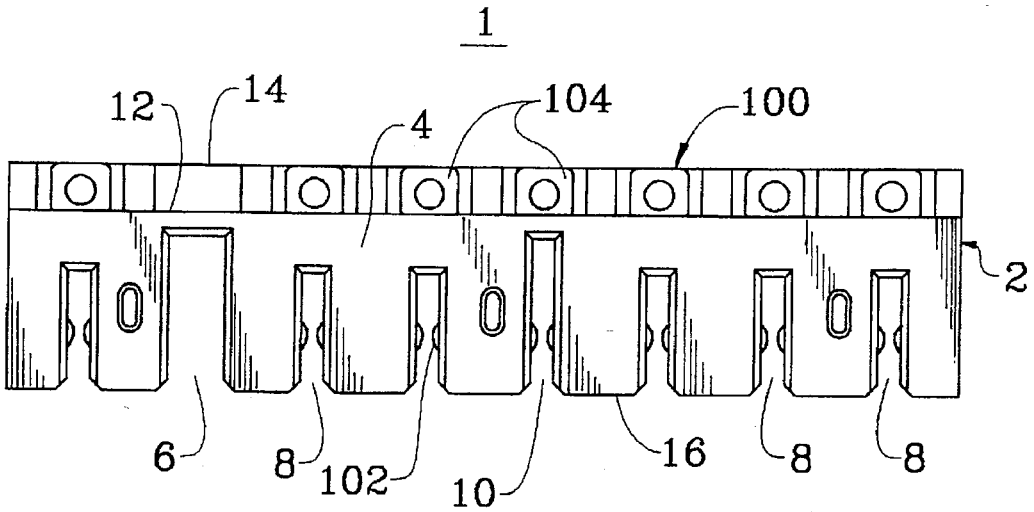
FIG. 1 is a top view of an electrical connector according to this invention.

FIG. 1 shows an electrical connector 1 according to this invention. Connector 1 is nearly rectangular in forth and is mounted in notebook computers at the location of the battery pack. On an upper surface 4 of a housing 2, slots 6, 8, 10 are provided which correspond to the contact cavities 3 (FIG. 8) intended for the placement of the receptacle contacts 100. The contacting areas 102 of the contacts 100 are exposed and can be seen in the slots 8 and 10. However, there is no contact 100 in slot 6. Slot 6 is intended for the accommodation of a rib of a mating connector (not shown) or for so-called "keying." The slots 6, 8, 10 extend through the bottom surface 18 of the housing 2 (FIG. 2) and are of the same width. Slot 10 is longer than slots 8 and it is intended for receipt of a grounding contact. Short slots 8 are intended for the accommodation of contacts 100. Slot 10 is longer than slots 8 because the grounding contact of the mating connector is longer than other mating tab contacts (not shown). Therefore, when the mating connectors are joined together, the grounding contacts make connection first. Conductor-connecting members 104 extend upwardly from the rear surface 12 of housing 2. A reinforcement rib 14 is an integral part of the housing 2 and runs longitudinally along the rear surface 12 of housing 2. The housing 2 is made of glass-fiber reinforced nylon, PBT or other suitable plastic material.

Figure 2:
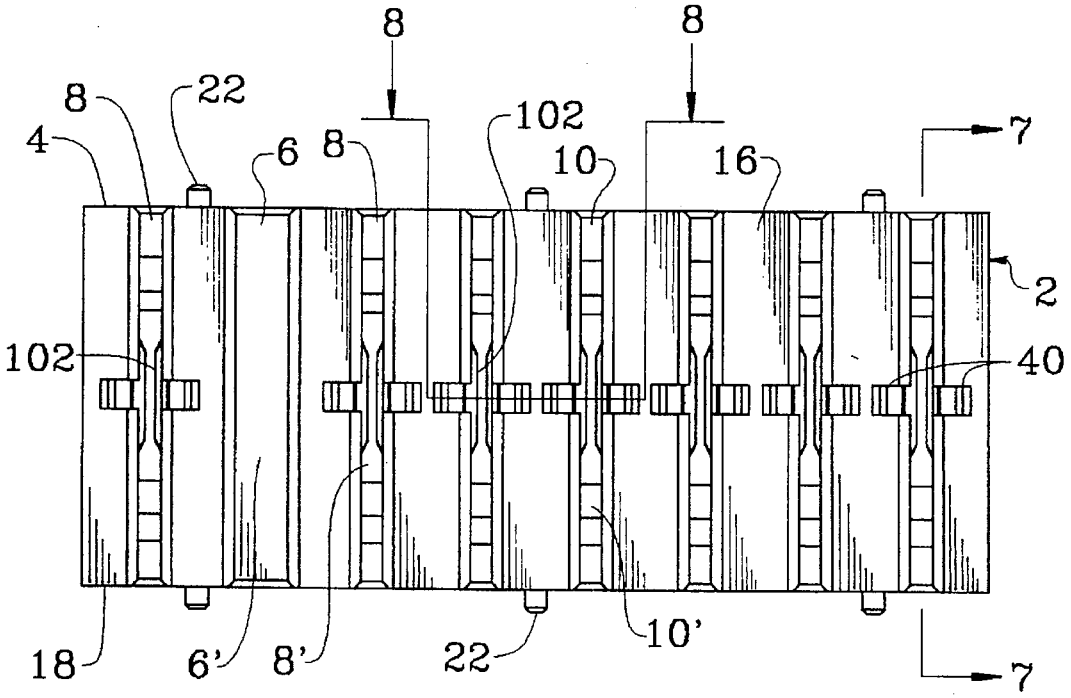
FIG. 2 is a front view of the electrical connector in FIG. 1.

FIG. 2 shows a front view of connector 1 in FIG. 1. The front surface 16 of connector 1 has slots 6', 8' and 10' connected to slots 6, 8 and 10 which extend from the upper surface 4 to the bottom surface 18 of the housing 2. Approximately at the center of the slots 8' and 10' grooves 40 are provided extending in the longitudinal direction of housing 2. If there is a need to remove a contact 100 from housing 2, it can be accomplished by releasing the latched connection by inserting a pointed tool in the corresponding groove 40. A mating connector can be inserted from the top, front or bottom, since housing 2 has slots 6, 6', 8, 8', 10, 10' in the upper surface 4, the front surface 16 and the bottom surface 18. The purpose of posts 22 is to locate connector 1 in the proper position when it is attached to the battery pack. Fastening devices (not shown) such as protrusions and depressions are used for fastening connector 1 from the upper surface 4 and the bottom surface 18 to prevent the housing 2 from slipping from the correct position.

Figure 3:
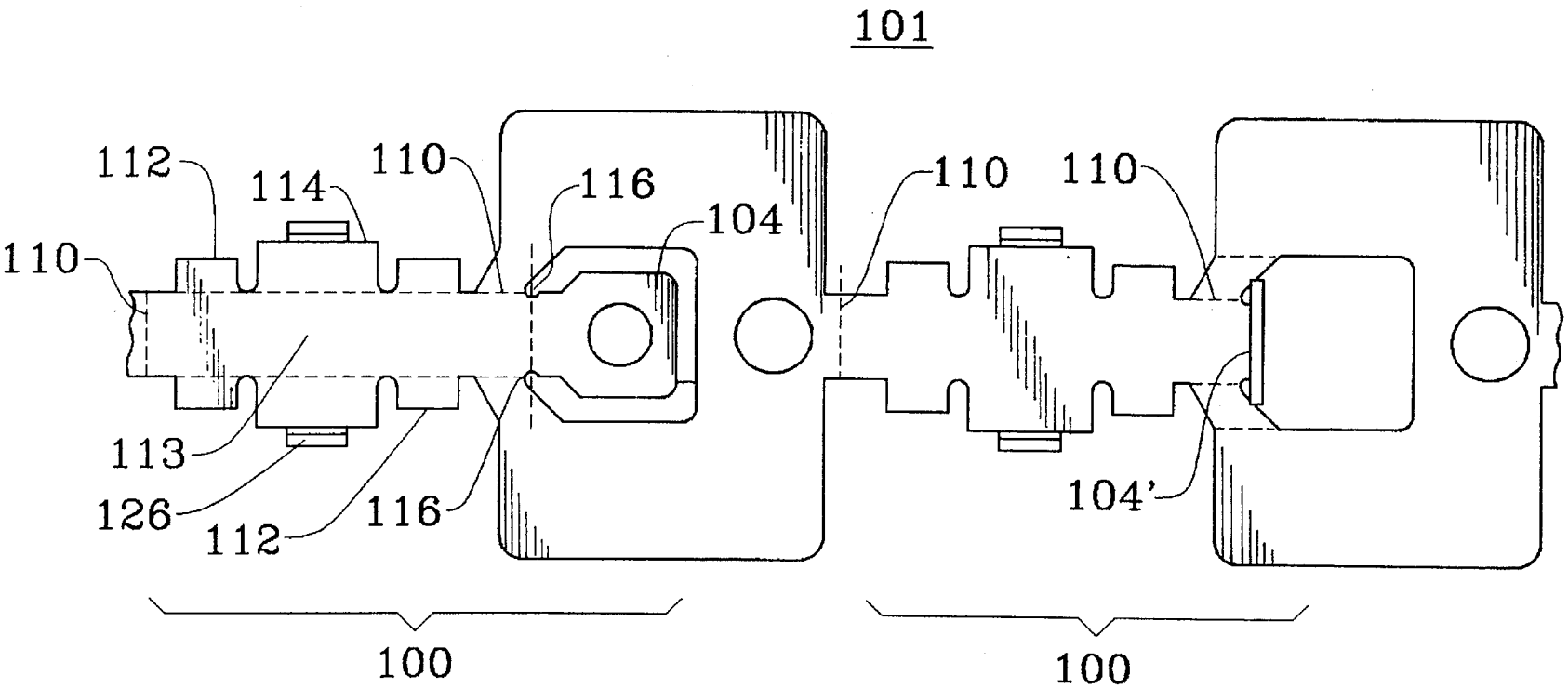
FIG. 3 is a partial top view of a strip of receptacle contacts according to this invention.

FIG. 3 is a partial top view of strip 101 of contacts 100 used in housing 2 of connector 1 according to this invention. This strip 101 is prepared by stamping, bending and forming a metal sheet, for example, phosphor bronze. The strip 101 is sheared in sections 110 corresponding to individual contacts. At the time of shearing, it is also possible to bend these sections. Contact arms 112 and lances 114 are bent from both sides of the base plate 113 in the direction below the plane of the drawing. The contact arms 112 and lances 114 are separated by a slot 125 (FIG. 4) made in the vicinity of the base plate 113 so that they can retain their springiness individually. The conductor-connecting member 104 is formed by a cutout 116 and is bent in the direction opposite to that of the contact arms 112, that is in the direction above the plane of the drawing as shown by conductor-connecting member 104'.

Figure 4:
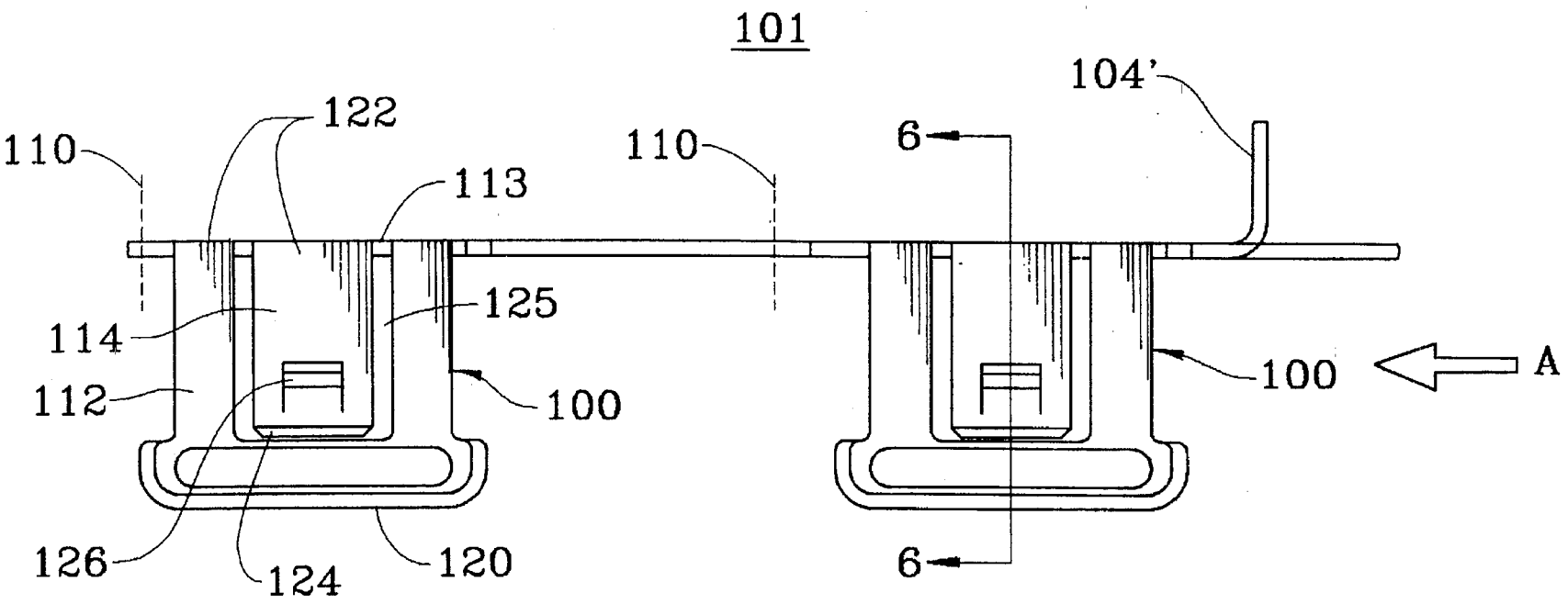
FIG. 4 is a side view of the strip in FIG. 3.

FIG. 4 represents a side view of the strip 101 shown in FIG. 3. The contact arms 112 of the contact 100 are bent downward and have a substantially rectangular shape. The front end 120 of the contact arm 112 is slightly wider than the rest of the contact arm 112. Within the contact arm 112, a U-shaped slot is made which forms the lance 114 extending from the fixed end 122 to the free front end 124. The front end 124 of the lance 114 is located in the same direction as the free front end 120 of the contact arm 112. Near the front end 124 of the lance 114, a primary latching member 126 is located which faces the fixed end 122.

Figure 5:
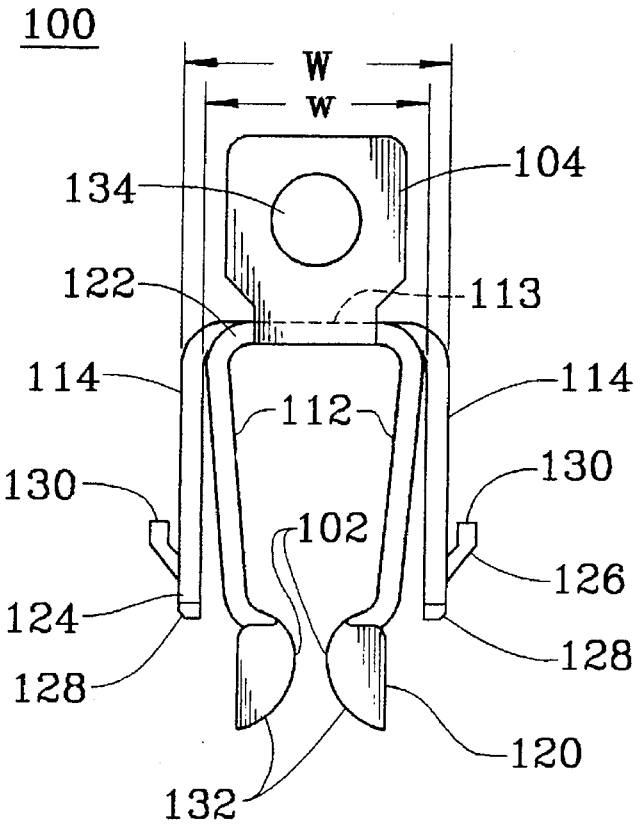
FIG. 5 is an end view of the receptacle contact in FIG. 4, in the direction of the arrow A.

FIG. 5 is a view in the direction of the arrow A of contact 100 shown in FIG. 4. In this view, the relative positions of the contact arms 112 and the lances 114 can be clearly seen. The contact arms 112 extend in a first direction from base plate 113, and the conductor-connection member 104 extends from one end in a second direction opposite that of the contact arms 112. The front ends 120 of the contact arms 112 are spaced slightly closer to each other than the fixed ends 122. On the other hand, the width "W" between the fixed ends 122 of the lances 114 is larger than the width "W" between the contact arms 112. The width between the lances 114 remains practically the same from their fixed ends 122 to their front ends 124. On the outer sides of the front ends 124, there are tapered sections 128. Latching members 126 of the lances are slanted from the side of the front ends toward the fixed ends 122 rising to the outside and have latching surfaces 130 facing the fixed ends 122 provided thereon. At the front ends 120 of the contact arms 112, rounded guiding surfaces 132 are provided to facilitate the engagement of mating contacts. The areas of these guiding surfaces 132 closest to each other are contact areas 102. The round hole 134 in the conductor-connection member 104 is intended for the insertion and soldering of an electrical wire (not shown). The heat from the soldering of an electrical wire to the hole 134 is transmitted to the lances 114 of the contact 110 and from there to the housing 2. However, since the latching members 126 are located near the front ends 124 of the lances 114, the effect of the heating is substantially reduced, therefore, there is no danger of housing 2 softening from the heat.

Figure 6:
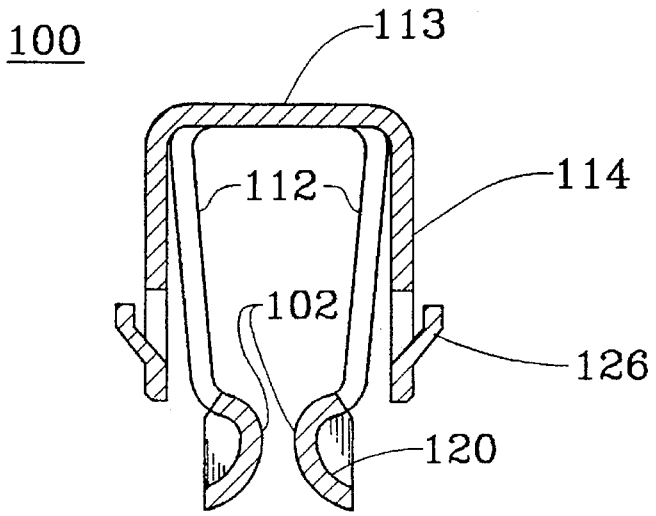
FIG. 6 is a cross-sectional view taken along line 6—6 of the receptacle contact in FIG. 4.

FIG. 6 is a cross-sectional view taken along line 6—6 of the contact 100 shown in FIG. 4. From this cross section, one can easily understand how the latching members 126 are made and how the front ends 120 of the contact arms 112 are formed. The rounded guiding surfaces 132 of front ends 120 facilitate the engagement of mating contacts which can take place from the following three directions in the connector housing 2: upper surface 4, front surface 16 or bottom surface 18.

Figure 7:
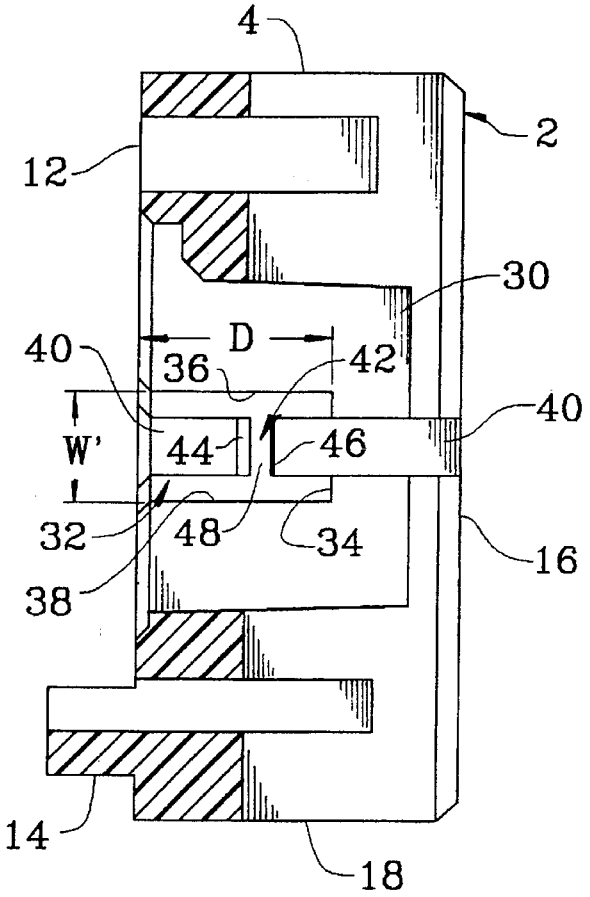
FIG. 7 is a cross-sectional view taken along 7—7 of the electrical connector in FIG. 2.

FIG. 7 is a cross-sectional view taken along line 7—7 of the connector 1 shown in FIG. 2. In FIG. 7, the contacts 100 are removed and only housing 2 is shown. Partition 30 in the drawing forms the contact cavity 3. On an inside surface 31 (FIG. 8) of the partition 30, a groove 32 is provided for the accommodation of the lance 114. The width "W" and the depth "D" of this nearly rectangular groove 32 is almost the same shape as the lance 114, but slightly larger than lance 114. Therefore, lance 114 prevents contact 100 from being pulled out of the housing 2 through the front surface 16 when the front end of lance 114 comes against the end surface 34 of the groove 32. In addition, lance 114 is in place between upper wall 36 and lower wall 38 of groove 32, thus restricting up and down movements of lance 114.

Groove 32 is connected with another groove 40 which runs from where contact 100 is inserted to front surface 16. In the groove 40, at the location in housing 2 corresponding to where latching member 126 is inplaced when the contact 100 is inserted in contact cavity 3 there is a secondary latching protrusion 42 having a latching surface 46. The height of protrusion 42 is nearly equal to the depth of the groove 40 and the inner latching surface 46 of protrusion 42 is on the same level as the bottom of groove 32, which extends perpendicular to the plane of the drawing. Therefore, when the contact 100 is inserted in housing 2, the front end 124 of lance 114 does not engage against protrusion 42 and does not chip it. The outer surface 44 of protrusion 42, is slanted surface. When the contact 100 is inserted, latching member 126 of lance 114 engages the slanted surface 44. When contact 100 passes over the top surface 48, the lance 114 snaps back and locking surface 130 of latching member 126 becomes engaged with the latching surface 46 of protrusion 42, thus preventing contact 100 from being pulled out.

Figure 8:
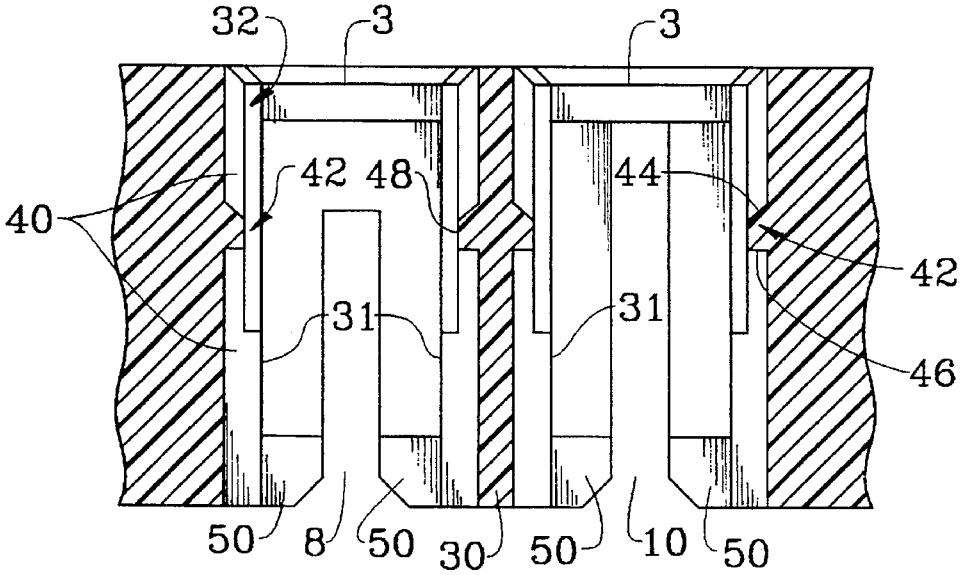
FIG. 8 is a partial cross-sectional view taken along 8—8 of the electrical connector in FIG. 2.

FIG. 8 is a partial cross-sectional view taken along line 8—8 of connector 1 shown in FIG. 2. In FIG. 8, the contacts 100 are removed. FIG. 8. clearly demonstrates the relative positions of groove 32, groove 40 and protrusion 42. A protective wall 50 protects front end 120 of contact 100 and is an integral part of housing 2.

Figure 9:
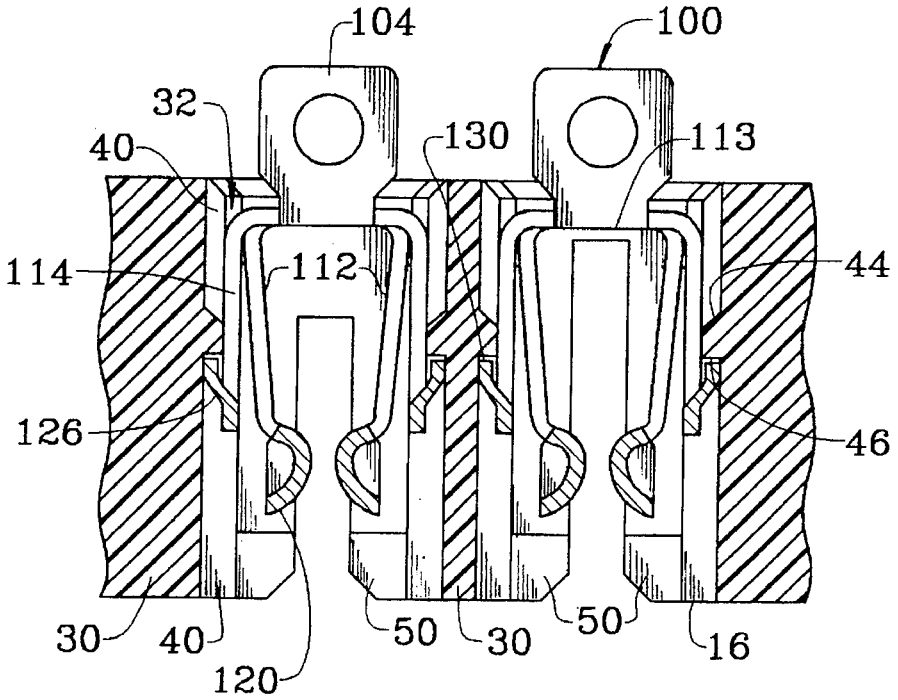
FIG. 9 is the same view as that of FIG. 8 with the receptacle contacts inserted in the housing.
Figure 10:
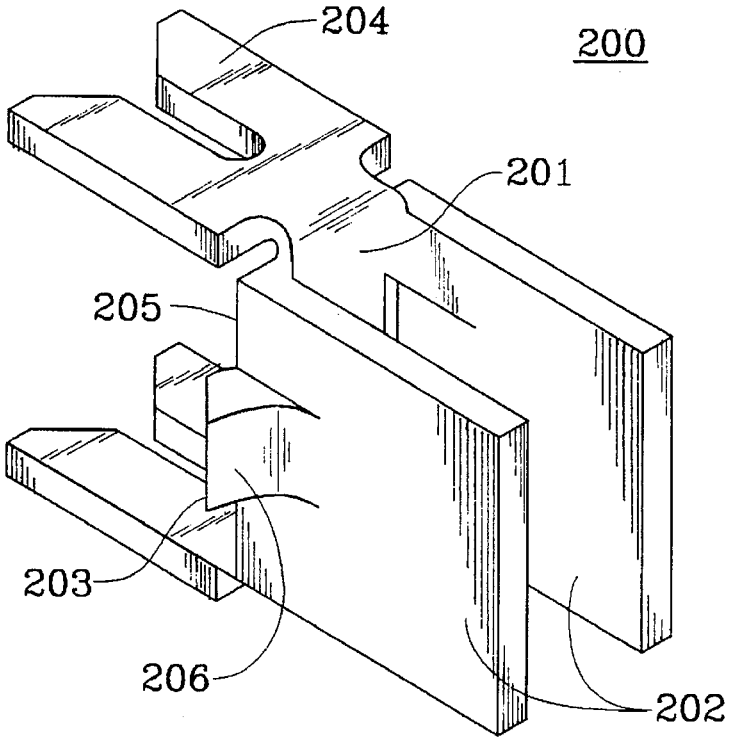
FIG. 10 ( PRIOR ART )
FIG. 10 is a perspective view of a conventional receptacle contact.

FIG. 9 is a cross-sectional view representing a portion of the housing 2 shown in FIG. 8 with contacts 100 inserted and latched in place. The contact arms 112 have sufficient springiness because when the contacts 100 are fully inserted they are located at a distance from partitions 30, as are front ends 120 which are also separated from protective wall 50. And since the front ends 120 are protected by the protecting wall 50, there is no danger of their deformation by incorrectly engaging mating contacts or by a foreign object inserted by accident.

Above, detailed explanations are given concerning the preferred embodiment of this invention, but it is needless to say that various modifications and changes can be made in it without omitting essential features of this invention. For example, instead of the latching members 126 of lance 114, an opening may be made in lances 114 to engage lugs provided in contact cavities 3 of housing 2. Another possible modification comprises increasing the distance between the front ends of the lances 114, which will result in a stronger pressure of lances 114 against the inside walls of grooves 32 (FIG. 8) when the contact 100 is inserted in housing 2.

I claim:

1. A receptacle contact comprising:

a base plate;

a pair of contact arms for forming electrical connection with a mating contact, extending from said base plate and having a U-shaped slot, whereby front ends of said contact arms are spaced closer together than inner ends attached at said base plate;

a pair of lances extending from said base plate adjacent said contact arms formed from said U-shaped slot in the contact arms, whereby free ends of said lances are spaced substantially the same distance as fixed ends located at said base plate; and at least one conductor-connecting member extending from said base plate.

2. A receptacle contact of claim 1, wherein said lances are outside and spread wider than said contact arms.

3. A receptacle contact of claim 1, wherein said lances have latching members to engage a latch in a dielectric housing.

4. A receptacle contact of claim 3, wherein said latching members face outwardly and towards said base plate.

5. A receptacle contact of claim 1, wherein said front ends of the contact arms have rounded guiding surfaces to facilitate the engagement of a mating contact therebetween.

6. A receptacle contact of claim 1, wherein the conductor-connecting member extends in a direction opposite to that of said contact arms and said lances.

7. An electrical connector comprising:

a dielectric housing having at least one cavity, grooves located along opposed surfaces of said cavity, latching protrusions in said grooves;

an electrical contact disposed in said cavity including a base plate from which a pair of contact arms extend for forming an electrical connection with a mating contact whereby front ends of the contact arms are spaced closer together than inner ends thereof attached at said base plate, a pair of lances extending from said base plate adjacent said contact arms and being formed from generally U-shaped slots in the contact arms, whereby free ends of the lances are spaced substantially the same distance as fixed ends thereof located at said base plate, latching members of said lances engaging said latching protrusions thereby retaining the electrical contact in the cavity, and at least one conductor-connecting member extending from said base plate.

8. A connector of claim 7, wherein said housing includes a slot for said cavity to receive a mating contact from a mating connector.

9. A connector of claim 8, wherein said slot includes access for said mating contact at the upper surface, bottom surface and front surface of said housing.

10. A connector of claim 8, wherein said housing includes at least another slot that is longer than said slot to receive a ground contact which is longer than the mating contact of the said mating connecter before the engagement of the mating contacts.

11. A connector of claim 8, wherein said housing has a keying means for proper alignment of said connecter and the mating connector.

12. A connector of claim 7, wherein said housing has groove means adjacent said grooves to allow for the removal of said contact from said cavity.

13. An electrical connector comprising:

a dielectric housing having at least one cavity, grooves located along opposed surfaces of said cavity, latching surfaces provided in said grooves;

an electrical contact disposed in said cavity including a base plate from which a pair of contact arms and a pair of lances extend alongside one another in the same direction with the contact arms being spaced inwardly toward a center axis of said cavity from said lances and said lances extending along the opposed surfaces of said cavity, and latching members on said lances engaging said latching surfaces thereby retaining the electrical contact in said cavity.

14. An electrical connector as claimed in claim 13, wherein said lances are positioned in other grooves in communication with said grooves.

15. An electrical connector as claimed in claim 13, wherein a conductor-connecting member extends from said base plate.

16. An electrical connector as claimed in claim 13, wherein said housing includes a slot in communication with said cavity to receive a mating electrical contact from a mating electrical connector.

17. An electrical connector as claimed in claim 11, wherein said slot includes access for the mating contact at an upper surface, bottom surface and front surface of said housing.

* * * * *